US010478041B2

(12) United States Patent
Ser et al.

(10) Patent No.: US 10,478,041 B2
(45) Date of Patent: Nov. 19, 2019

(54) SEALING MEMBER AND DISHWASHER HAVING THE SAME

(71) Applicant: SAMSUNG ELECTRONICS CO., LTD., Suwon-si, Gyeonggi-do (KR)

(72) Inventors: Young Su Ser, Hwaseong-si (KR); Gong Soo Kim, Suwon-si (KR); Jae Man Joo, Yongin-si (KR)

(73) Assignee: SAMSUNG ELECTRONICS CO., LTD., Suwon (KR)

( * ) Notice: Subject to any disclaimer, the term of this patent is extended or adjusted under 35 U.S.C. 154(b) by 254 days.

(21) Appl. No.: 14/532,217

(22) Filed: Nov. 4, 2014

(65) Prior Publication Data

US 2015/0123524 A1 May 7, 2015

(30) Foreign Application Priority Data

Nov. 6, 2013 (KR) ..... 10-2013-0134273

(51) Int. Cl.
*A47L 15/42* (2006.01)

(52) U.S. Cl.
CPC ..... *A47L 15/4263* (2013.01)

(58) Field of Classification Search
CPC ..... A47L 15/4263
See application file for complete search history.

(56) References Cited

U.S. PATENT DOCUMENTS 3,603,035 A * 9/1971 Kaldenberg ..... A47L 15/4263 49/479.1
2005/0257816 A1* 11/2005 Kim ..... A47L 15/4263 134/200

FOREIGN PATENT DOCUMENTS

| | | |
|---|---|---|
| KR | 1998-082339 | 12/1998 |
| KR | 20-0215082 | 3/2001 |
| KR | 10-2008-0071352 | 8/2008 |
| KR | 10-2009-0111057 | 10/2009 |
| KR | 10-1054115 | 8/2011 |

OTHER PUBLICATIONS

Korean Office Action dated Jun. 27, 2019 in corresponding Korean Patent Application No. 10-2013-0134273.
Korean Office Action dated Sep. 2, 2019 in corresponding Korean Patent Application No. 10-2013-0134273.

* cited by examiner

*Primary Examiner* — Spencer E Bell
(74) *Attorney, Agent, or Firm* — Staas & Halsey LLP

(57) ABSTRACT

A dishwasher includes a main body, a washing tub that is disposed inside the main body and includes an opening formed on a front surface thereof, a door that opens and closes the opening, and a sealing member that seals between the washing tub and the door. The sealing member includes a fixing unit that is fixed to a lower portion of the door, and a sealing unit that extends toward a front side of the washing tub from the fixing unit and is brought into contact with an inner surface of the washing tub.

23 Claims, 8 Drawing Sheets

SEALING MEMBER AND DISHWASHER HAVING THE SAME

CROSS-REFERENCE TO RELATED APPLICATIONS

This application claims the benefit of Korean Patent Application No. 10-2013-0134273, filed on Nov. 6, 2013 in the Korean Intellectual Property Office, the disclosure of which is incorporated herein by reference.

BACKGROUND

1. Field

Embodiments of the present disclosure relate to a sealing member that seals between a washing tub and a door of a dishwasher and a dishwasher having the same.

2. Description of the Related Art

A dishwasher more easily and hygienically executes washing of tableware, and is a device that automatically washes food waste attached to a variety of cooking tools (hereinafter, referred to as "tableware") such as the cutlery, crockery, and the like using a detergent and washing water.

In general, the dishwasher includes a main body, a washing tub which is provided inside the main body and stores tableware, and a door that opens and closes the washing tub. A sealing member is provided in the door, and seals a space between the door and the washing tub, thereby preventing high-temperature humidified steam generated inside the tub from being leaked to the outside.

In the prior art, there are problems in which a separate fixed bracket or the like required for coupling the sealing member to the door causes an increase in the material costs, and a complex process of coupling the sealing member to the door using the fixed bracket causes a decrease in the production efficiency. In addition, there is a problem that foreign substances introduced into a specific space between the sealing member and the washing tub are accumulated on the washing tub without being smoothly washed in a state in which the door closes the washing tub.

SUMMARY

Therefore, it is an aspect of the present disclosure to provide a sealing member which has improved efficiency, and a dishwasher having the same.

It is another aspect of the present disclosure to provide a sealing member which is improved to prevent foreign substances from being accumulated on a space between the sealing member and a washing tub and a dishwasher having the same.

Additional aspects of the disclosure will be set forth in part in the description which follows and, in part, will be apparent from the description, or may be learned by practice of the disclosure.

In accordance with one aspect of the present disclosure, a dishwasher includes a main body; a washing tub that is disposed inside the main body and includes an opening formed on a front surface thereof; a door that opens and closes the opening; and a sealing member that seals between the washing tub and the door. Here, the sealing member may include a fixing unit that is fixed to a lower portion of the door, and a sealing unit that extends toward a front side of the washing tub from the fixing unit and is brought into contact with an inner surface of the washing tub.

Also, a hardness of a material of the fixing unit may be different from a hardness of a material of the sealing unit.

Also, the fixing unit may have relatively greater hardness than that of the sealing unit.

Also, in a state in which the door closes the opening, a washing water flow path may be formed between the sealing member and a lower surface of the washing tub so that a washing water is introduced through the washing water flow path.

Also, the sealing unit may include a bending guide unit that guides bending deformation of the sealing unit in a process in which the door opens the opening.

Also, the bending guide unit may be provided to have a shape that is bent toward the front surface of the washing tub.

Also, the sealing unit may include first and second elastic deformation portions that extend toward the front side of the washing tub from the fixing unit and are elastically deformed in a process in which the door opens and closes the opening, and a contact portion that connects the first and second elastic deformation portions and is brought into contact with the inner surface of the washing tub.

Also, the first and second elastic deformation portions may be spaced apart from each other, the first elastic deformation portion may be disposed above the second elastic deformation portion, and the bending guide unit may be provided in the first elastic deformation portion.

Also, an interval between the first and second elastic deformation portions may be increased in at least a partial section toward the front side of the washing tub.

Also, the fixing unit may include a support unit that supports the sealing unit, a first fastening unit that extends toward the front side of the washing tub from an upper end of the support unit, and a second fastening unit that extends toward a lower surface of the washing tub from a lower end of the support unit.

Also, the first fastening unit may include at least one fixing groove.

Also, the second fastening unit may include a fastening protrusion that is bent toward the front side of the washing tub from an end of the second fastening unit.

Also, the door may include a first frame that is formed to cover the opening and a second frame that is disposed on a front side of the first frame, the first frame may have a receiving groove that receives the fastening protrusion, and the second frame may have at least one insertion protrusion that is inserted into the at least one fixing groove.

Also, at least a part of the second fastening unit may be brought into contact with the first frame.

Also, the sealing member may include at least one strength reinforcement rib that extends toward a rear side of the washing tub from the fixing unit to reinforce strength of the sealing member.

Also, an end portion of the at least one strength reinforcement rib may be supported by the first frame.

In accordance with another aspect of the present disclosure, a dishwasher includes a main body; a washing tub that is disposed inside the main body, and includes a front surface frame forming an opening and a lower surface frame connected to a lower side of the front surface frame; a door that opens and closes the opening, and includes a first frame formed to cover the opening and a second frame disposed on a front side of the first frame; and a sealing member that is coupled to a lower portion of the door, and brought into contact with an inner surface of the front surface frame to seal between the washing tub and the door. Here, the sealing member may include a first elastic unit that has a first hardness, and a second elastic unit that has a second hardness smaller than the first hardness, and is integrally formed with the first elastic unit.

Also, an end of the first elastic unit may be fixed to the first frame, and another end of the first elastic unit may be fixed to the second frame.

Also, the second elastic unit may extend to have a shape that is curved toward the front surface frame from the first elastic unit, and be brought into contact with the inner surface of the front surface frame.

Also, in a process in which the door opens the opening, the second elastic unit may be bent and deformed in a first direction, and bent and deformed in a second direction opposite to the first direction.

Also, the end of the first elastic unit may pressurize the second elastic unit so that the second elastic unit is bent and deformed in the second direction.

Also, in a process in which the door closes the opening, the second elastic unit may be bent and deformed in the first direction.

Also, in a process in which the door opens the opening, a space between the first elastic unit and the front surface frame may be gradually reduced.

Also, in a state in which the door closes the opening, a washing water flow path may be formed between the second elastic unit and the lower surface frame so that a washing water is introduced through the washing water flow path.

In accordance with still another aspect of the present disclosure, a sealing member that seals a gap between a door for opening and closing a washing tub disposed inside a main body and the washing tub, includes a first elastic unit that is fixed to the door; and a second elastic unit that extends from the first elastic unit and is brought into contact with an inner surface of the washing tub. Here, in a process in which the door opens the washing tub, the second elastic unit may be bent and deformed in a first direction and a second direction opposite to the first direction, and in a process in which the door closes the washing tub, the second elastic unit may be bent and deformed in the first direction.

Also, in the process in which the door closes the washing tub, the first elastic unit may pressurize the second elastic unit so that the second elastic unit is bent and deformed in the first direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
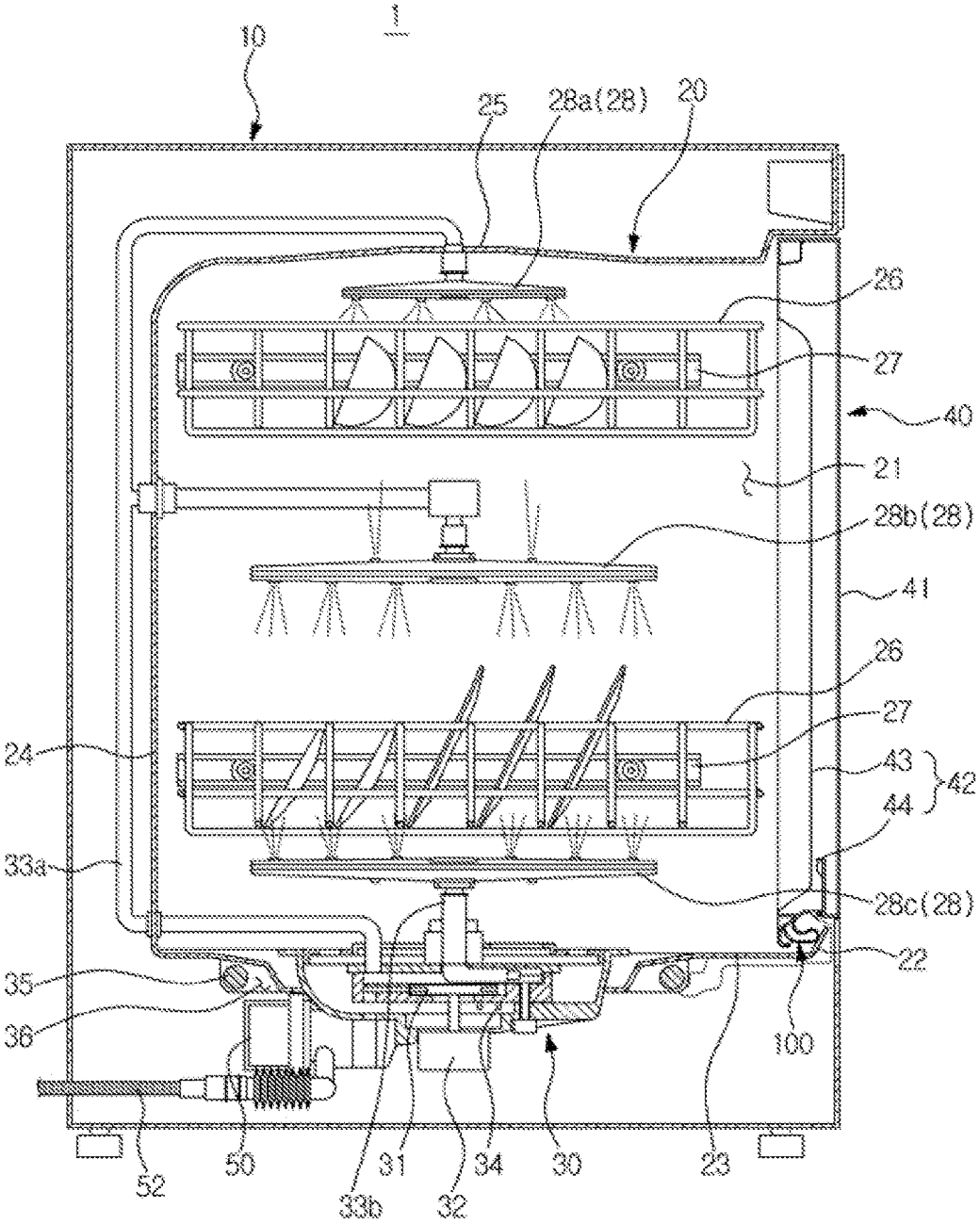
FIG. 1 is a view showing a dishwasher in accordance with one embodiment of the present disclosure.

Reference will now be made in detail to the embodiments of the present disclosure, examples of which are illustrated in the accompanying drawings, wherein like reference numerals refer to like elements throughout.

Hereinafter, preferred embodiments of the present disclosure will be described in detail with reference to the accompanying drawings.

Figure 2:
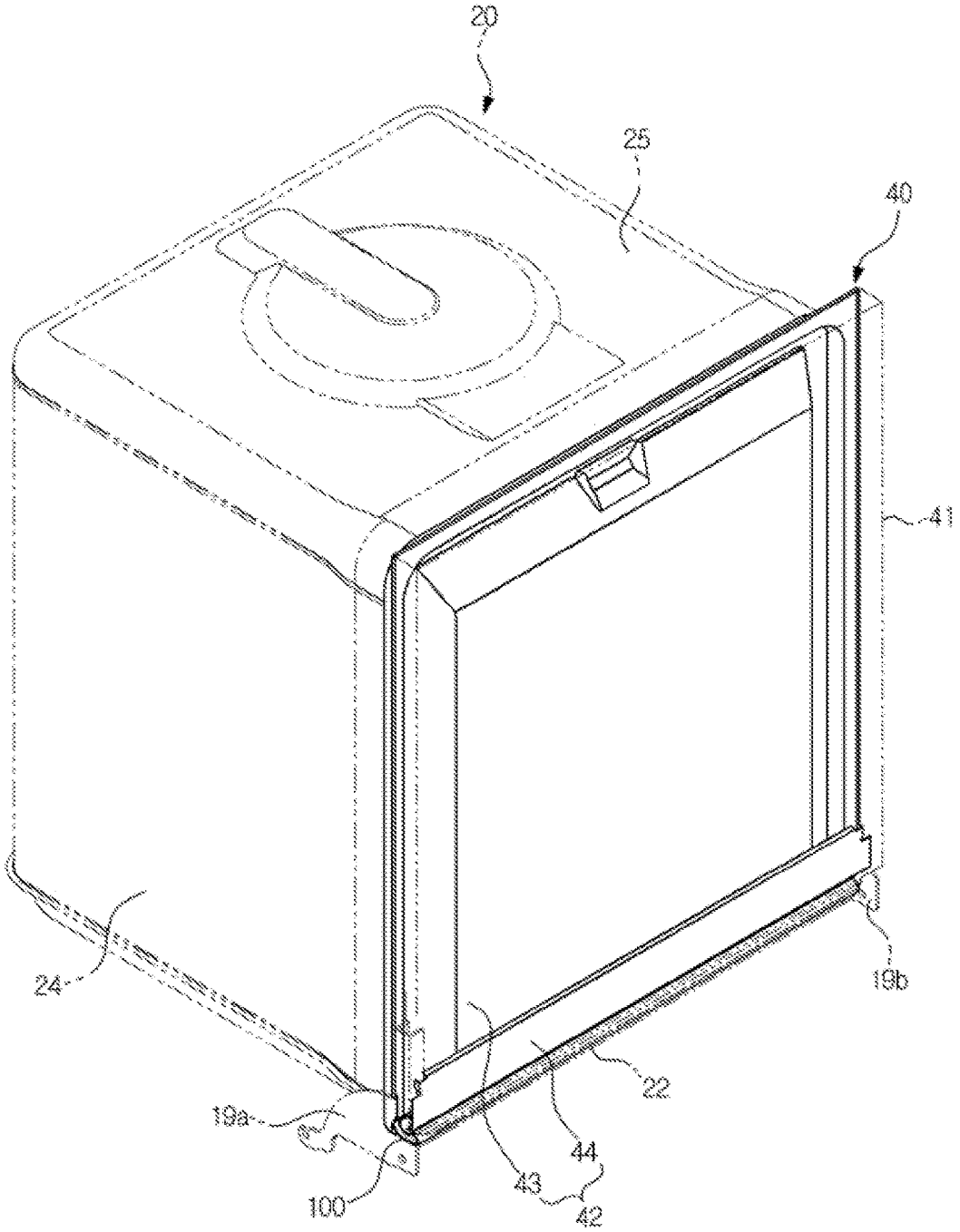
FIG. 2 is a perspective view showing a washing tub, a door, and a sealing member of FIG. 1.

FIG. 1 is a view showing a dishwasher in accordance with one embodiment of the present disclosure, and FIG. 2 is a perspective view showing a washing tub, a door, and a sealing member of FIG. 1.

A dishwasher 1 may include a main body 10, a washing tub 20 that is provided inside the main body 10 to form a washing space, a sump 30 that is provided in a lower portion of the washing tub 20 to store a washing water, and a door 40 that opens and closes a front side of the washing tub 20.

A front surface of the main body 10 is opened so that tableware can be stored in or withdrawn from the washing tub 20.

The washing tub 20 includes an opening 21 that communicates with the opened front surface of the main body 10, a front surface frame 22 that forms the opening 21, a lower surface frame 23 that is connected to a lower side of the front surface frame 22, a side surface frame 24 that is connected to the front surface frame 22 and the lower surface frame 23, and an upper surface frame 25 that covers the front surface frame 22 and the side surface frame 24.

In the washing tub 20, at least one tableware basket 26 in which tableware is stored, at least one rack 27 that supports the at least one tableware basket 26 so that the tableware basket 26 can be slidably moved, and at least one injection nozzle 28 that injects a washing water are provided. Here, the at least one injection nozzle 28 may include a top nozzle 28*a*, an upper nozzle 28*b*, and a lower nozzle 28*c*.

In the washing tub 20, a heater 35 for heating a washing water, and a heater installation groove 36 are formed. The heater installation groove 36 is provided in the lower surface frame 23 of the washing tub 20, and the heater 35 is installed in the heater installation groove 36.

The sump 30 is provided in a center portion of the lower surface frame 23 of the washing tub 20 to collect and pump the washing water.

The sump 30 includes a washing pump 31 that pumps the washing water at high pressure, and a pump motor 32 that drives the washing pump 31. The washing pump 31 pumps the washing water to the top nozzle 28*a* and the upper nozzle 28*b* through a first supply pipe 33*a*, and pumps the washing water to the lower nozzle 28*c* through a second supply pipe 33*b*.

The sump 30 may include a turbidity sensor 34 for detecting a pollution level of the washing water. A control unit (not shown) of the dishwasher 1 may detect the pollution level of the washing water using the turbidity sensor 34, and control the number of times of performing a washing operation or a rinsing operation. That is, it is possible to increase the number of times of performing the washing operation or rinsing operation when the pollution level is high, and reduce the number of times of performing the washing operation or rinsing operation when the pollution level is low.

In a lower portion of the sump 30, a drain pump 50 and a drain hose 52 which drain the polluted washing water to the outside of the dishwasher 1 are provided.

The door 40 is rotatably coupled to the main body 10 so as to open and close the opening 21. On both sides of the door 40, hinge members 19*a* and 19*b* that connect the door 40 and the main body 10 are provided. The door 40 includes an outer frame 41 that defines an outer appearance thereof, and an inner frame 42 that is disposed inside the outer frame 41. The inner frame 42 includes a first frame 43 that is formed to cover the opening 21, and a second frame 44 that is disposed on a front side of the first frame 43. The first frame 43 includes a support protrusion 43*a* that is formed by bending a lower end of the first frame 43, and a receiving groove 43*b* that is formed in an end of the support protrusion 43*a* (see FIGS. 3 and 5). The second frame 44 includes at least one insertion protrusion 44*a* that is formed by bending a lower end of the second frame 44 (see FIGS. 3 and 5).

A sealing member 100 that seals between the washing tub 20 and the door 40 is provided in a lower portion of the door 40.

Figure 3:
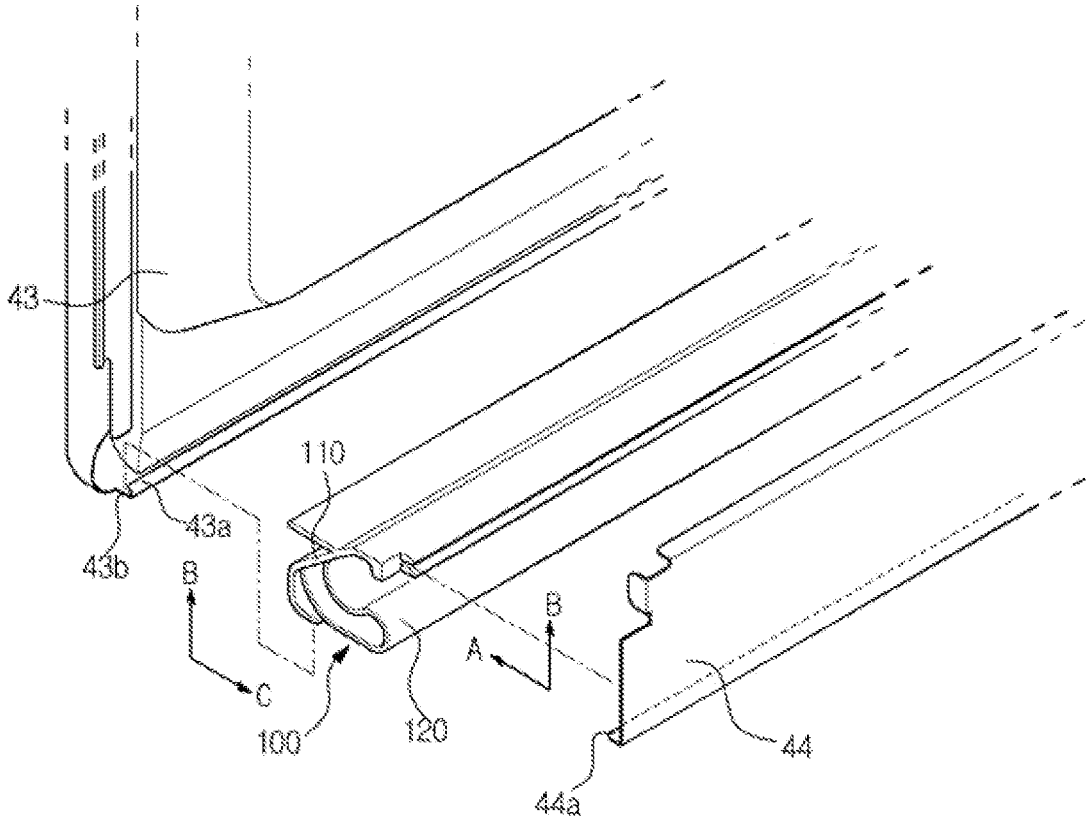
FIG. 3 is an exploded perspective view showing a coupling relationship between a door and a sealing member.
Figure 4:
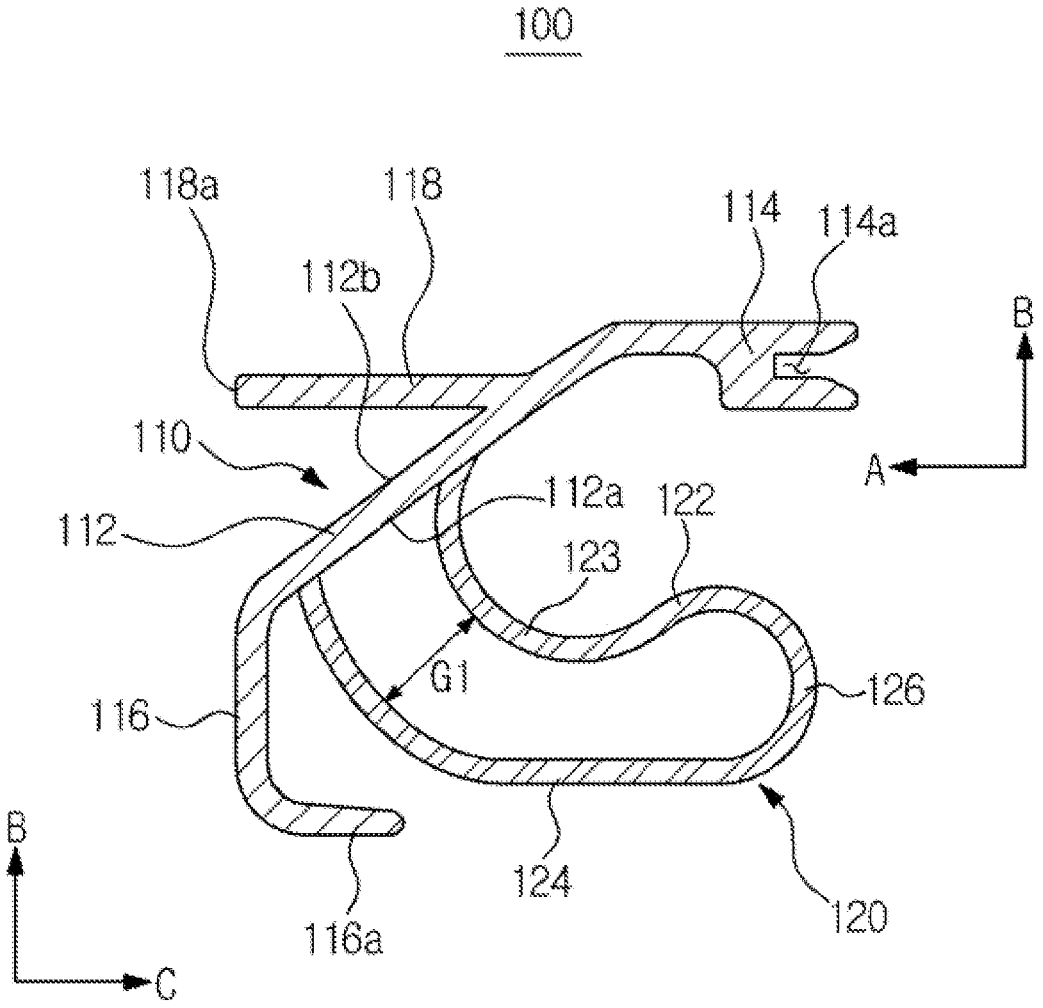
FIG. 4 is a cross-sectional view showing a sealing member.
Figure 5:
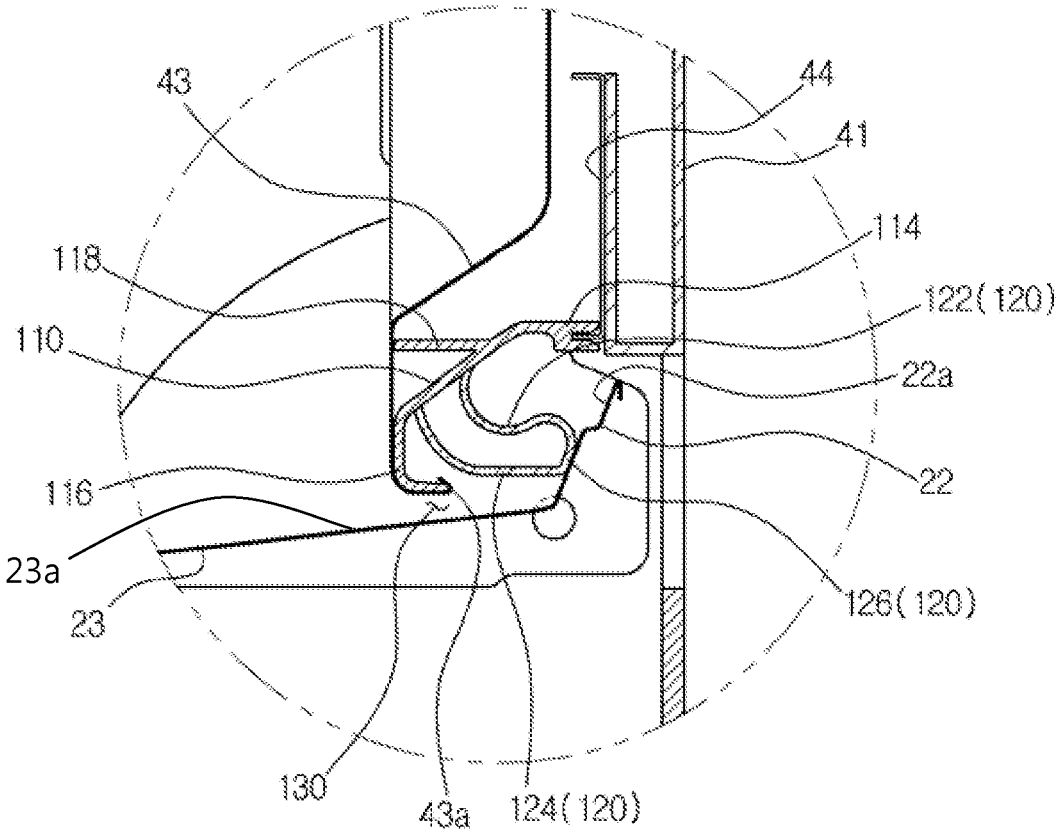
FIG. 5 is a cross-sectional view obtained by expanding an "A" portion of FIG. 1, and showing a configuration of a sealing member and a peripheral configuration of the sealing member in a state in which a door closes an opening.
Figure 6:
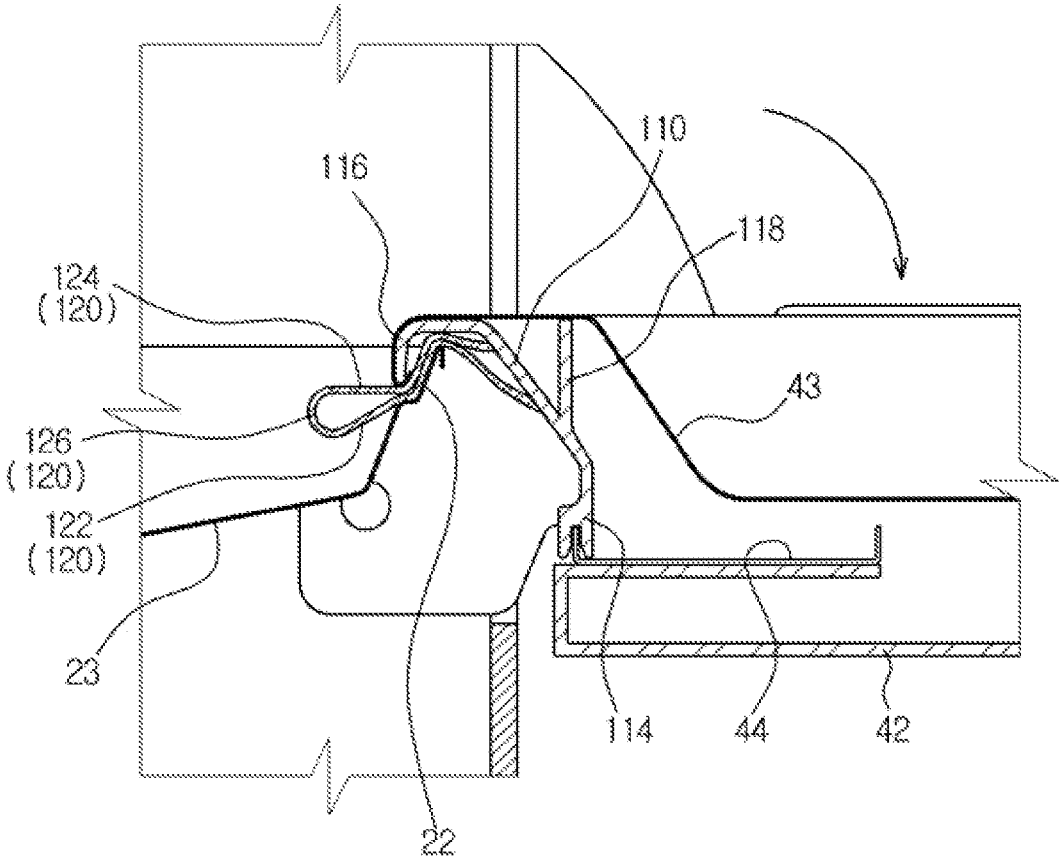
FIG. 6 is a cross-sectional view showing a configuration of a sealing member and a peripheral configuration of the sealing member in a state in which a door opens an opening.

FIG. 3 is an exploded perspective view showing a coupling relationship between a door and a sealing member, FIG. 4 is a cross-sectional view showing a sealing member, FIG. 5 is a cross-sectional view obtained by expanding an "A" portion of FIG. 1 and showing a configuration of a sealing member and a peripheral configuration of the sealing member in a state in which a door closes an opening, and FIG. 6 is a cross-sectional view showing a configuration of a sealing member and a peripheral configuration of the sealing member in a state in which a door opens an opening.

As shown in FIGS. 2 to 6, the sealing member 100 is formed long in a horizontal direction of the door 40, and includes a fixing unit 110 that is fixed to a lower portion of the door 40 and a sealing unit 120 that is brought into contact with an inner surface of the washing tub 20 to seal between the door 40 and the washing tub 20.

The fixing unit 110 includes a support unit 112 that supports the sealing unit 120, and first and second fastening units 114 and 116 which are formed on both ends of the support unit 112.

The first fastening unit 114 extends toward a front side of the washing tub 20 from an upper end of the support unit 112, and the second fastening unit 116 extends toward the lower surface frame 23 of the washing tub 20 from a lower end of the support unit 112.

A fixing groove 114*a* is provided in an end of the first fastening unit 114. The insertion protrusion 44*a* of the second frame 44 is inserted into the fixing groove 114*a*. The insertion protrusion 44*a* is inserted into the fixing groove 114*a* to support the fixing unit 110 in an A direction and a B direction perpendicular to the A direction. Although not shown, a plurality of fixing grooves 114*a* and insertion protrusions 44*a* may be provided in a vertical direction of the door 40.

The second fastening unit 116 includes a fastening protrusion 116*a* that is bent toward the front side of the washing tub 20 from an end of the second fastening unit 116. The fastening protrusion 116*a* is received in the receiving groove 43*b* of the first frame 43. The second fastening unit 116 is brought into contact with a lower end front surface of the first frame 43 to be supported in a C direction opposite to the A direction by the lower end front surface of the first frame 43, and the fastening protrusion 116*a* is supported in the B direction perpendicular to the A direction by the support protrusion 43*a* of the first frame 43.

In this manner, the sealing member 100 is fixed directly to the door 40 through the fixing unit 110, and therefore a separate component for fixing the sealing member 100 to the door 40 is not required which causes a reduction in material costs, and a fastening element such as a bolt, a rivet, and the like is not required to be used which causes an improvement in productivity.

A strength reinforcement rib 118 for reinforcing strength of the support unit 112 is provided on another surface 112*b* of the support unit opposite to a surface 112*a* of the support unit 112 on which the sealing unit 120 is provided. The strength reinforcement rib 118 extends toward a rear side of the washing tub 20 from the other surface 112*b* of the support unit 112. An end portion 118*a* of the strength reinforcement rib 118 is brought into contact with the lower end front surface of the first frame 43 to be supported by the lower end front surface of the first frame 43. Although not shown, a plurality of strength reinforcement ribs 118 may be provided in a vertical direction of the door 40.

The sealing unit 120 includes first and second elastic deformation portions 122 and 124 which extend toward the front side of the washing tub 20 from the support unit 112 of the fixing unit 110 and are elastically deformed in a process in which the door 40 opens and closes the opening 21, and a contact portion 126 that connects the first and second elastic deformation portions 122 and 124 and is brought into contact with the inner surface of the washing tub 20.

The first and second elastic deformation portions 122 and 124 extend to have a shape that is curved toward the front side of the washing tub 20 from the support unit 112, and are spaced apart from each other in the vertical direction so that a change in the shape of the sealing unit 120 is easily performed in a process in which the door 40 opens and closes the opening 21.

The contact portion 126 is brought into contact with an inner surface 22*a* of the front surface frame 22 to seal the door 40 and the washing tub 20 in a state in which the door 40 closes the opening 21.

An end of the first elastic deformation portion 122 has a shape that protrudes upward, and an interval G1 between the first and second elastic deformation portions 122 and 124 is increased in at least a partial section toward the front side of the washing tub. Thus, in a process in which the door 40 closes the opening 21, an elastic restoring force is provided so that the sealing unit 120 can be naturally bent and deformed in a first direction C1.

The first elastic deformation portion 122 includes a bending guide unit 123. The bending guide unit 123 is provided to have a shape that is curved toward the front side of the washing tub 20. In the process in which the door 40 opens or closes the opening 21, the sealing unit may be naturally bent and deformed in the first direction C1 with respect to the bending guide unit 123.

In the state in which the door 40 closes the opening 21, a washing water flow path 130 is formed between the second elastic deformation portion 124 and an inner surface 23*a* of the lower surface frame 23 of the washing tub 20. The washing water introduced into the washing water flow path 130 washes foreign substances positioned in a corner space between the sealing unit 120 and the washing tub 20, and then is discharged through the washing water flow path 130. Thus, a phenomenon in which the foreign substances are accumulated in the corner space between the sealing unit 120 and the washing tub 20 is prevented.

The fixing unit 110 and the sealing unit 120 may be made of a material having elasticity such as rubber, plastic, or the like. The fixing unit 110 may be made of an elastic material having high hardness so that the shape deformation of the fixing unit 110 is suppressed in a process in which the door 40 is rotated while firmly fixing the sealing member 100 to the door 40, and the sealing unit 120 may be made of a soft elastic material having relatively lower hardness than that of the fixing unit 110 so that the shape of the sealing unit 120 is naturally deformed in a space between the door 40 and the washing tub 20 in the process in which the door 40 is rotated. In this manner, the fixing unit 110 and the sealing unit 120 may be made of elastic materials having mutually different hardness, and therefore the fixing unit 110 and the sealing unit 120 can be seen as a first elastic unit and a second elastic unit, respectively.

The fixing unit 110 and the sealing unit 120 may be integrally formed. The fixing unit 110 and the sealing unit 120 may use an extruding method so that the fixing unit 110 and the sealing unit 120 may be integrally formed. The material of the fixing unit 110 and the material of the sealing unit 120 are simultaneously pushed into and extruded from an extrusion die corresponding to the shape of the sealing member 100 including the shape of the fixing unit 110 and the shape of the sealing unit 120, so that the fixing unit 110 and the sealing unit 120 are integrally formed.

Hereinafter, a process in which the shape of the sealing member 100 is deformed while the opening 21 is opened and closed with the door 40 will be described in more detail.

Figure 7:
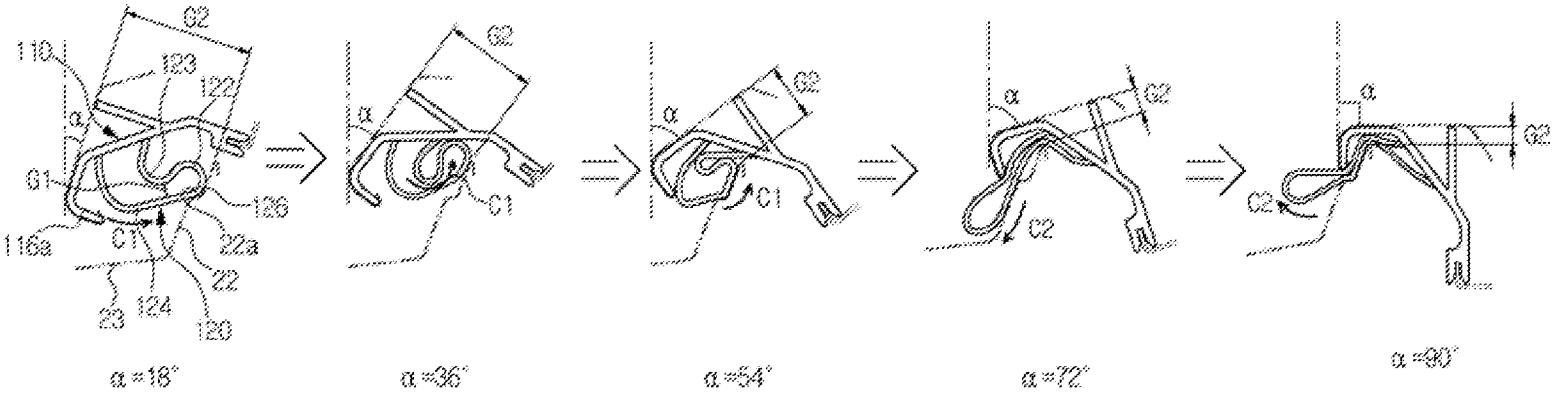
FIG. 7 is a view showing a state in which a shape of a sealing member is changed in a process in which a door opens an opening.
Figure 8:
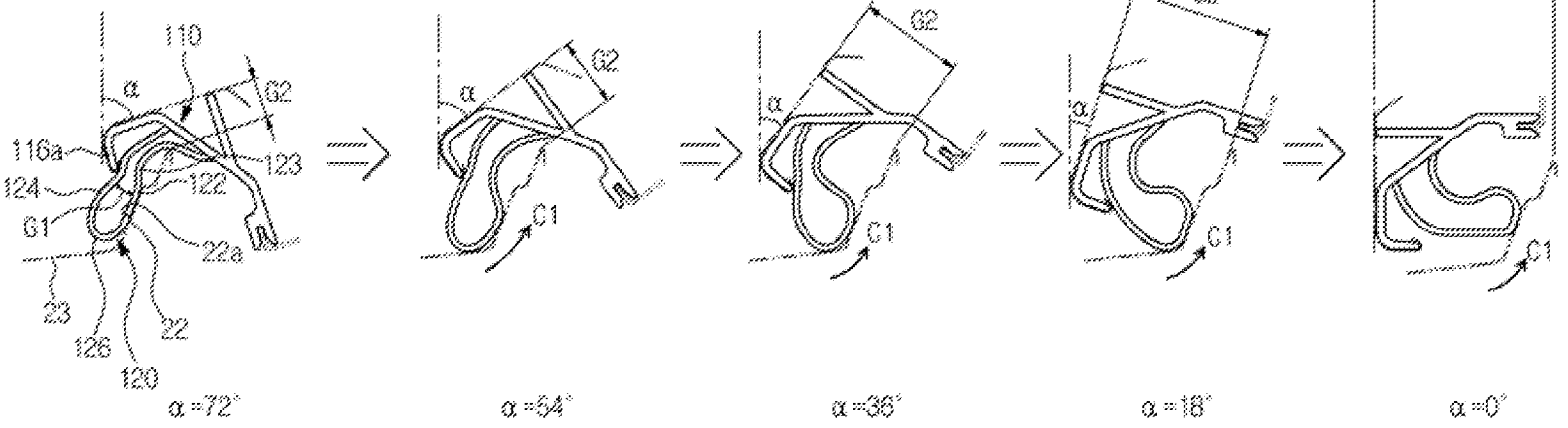
FIG. 8 is a view showing a state in which a shape of a sealing member is changed in a process in which a door closes an opening.

FIG. 7 is a view showing a state in which a shape of a sealing member is changed in a process in which a door opens an opening, and FIG. 8 is a view showing a state in which a shape of a sealing member is changed in a process in which a door closes an opening.

As shown in FIG. 7, when the door 40 starts to open the opening 21 of the washing tub 20 while rotating, an interval G2 between the fixing unit 110 of the sealing member 100 and the front surface frame 22 of the washing tub 20 is gradually reduced. As the interval G2 between the fixing unit 110 of the sealing member 100 and the front surface frame 22 of the washing tub 20 is gradually reduced, the sealing unit 120 is bent and deformed in the first direction C1 with respect to the bending guide unit 123 while the contact portion 126 of the sealing unit 120 is brought into contact with the inner surface 22*a* of the front surface frame 22. An interval G1 between the first and second elastic deformation portions 122 and 124 is gradually reduced around the bending guide unit 123.

When an open angle α of the door 40 is 54°, a bending deformation amount of the sealing unit 120 is increased, so that the first and second elastic deformation portions 122 and 124 are brought into contact with each other around the bending guide unit 123, and the contact portion 126 is brought into contact with the inner surface 22*a* of the front surface frame 22 and the first elastic deformation portion 122. In addition, the fastening protrusion 116*a* of the fixing unit 110 is brought into contact with the second elastic deformation portion 124 to support the sealing unit 120.

When the open angle α of the door 40 is 72°, the sealing unit 120 is restored to a shape close to its original shape by an elastic restoring force while a supporting force through which the fastening protrusion 116*a* supports the sealing unit 120 is weakened, so that, in this process, the first and second elastic deformation portions 122 and 124 are separated from each other, and one part of the sealing unit 120 including the contact portion 126 is separated from the space between the fixing unit 110 and the front surface frame 22.

When the open angle α of the door 40 exceeds 72°, the fastening protrusion 116*a* of the fixing unit 110 pressurizes the sealing unit 120 while being brought into contact with the second elastic deformation portion 124, and the sealing unit 120 is bent and deformed in a second direction C2 opposite to the first direction C1 with respect to a point pressurized by the fastening protrusion 116*a*.

When the open angle α of the door 40 is 90° by completely opening the opening 21 with the door 40, the first and second elastic deformation portions 122 and 124 are brought into contact with each other again around a point pressurized by the fastening protrusion 116*a*, and one part of the sealing unit 120 is positioned outside of the space between the fixing unit 110 and the front surface frame 22 of the washing tub 20 while being pressurized by the fastening protrusion 116*a* of the fixing unit 110. Here, the other part of the sealing unit 120 is positioned in the space between the fixing unit 110 and the front surface frame 22 of the washing tub 20.

In this manner, when the door 40 opens the opening 21 while rotating, a sealing state between the door 40 and the washing tub 20 is maintained while the sealing unit 120 is bent and deformed. Here, as the space between the fixing unit 110 and the front surface frame 22 of the washing tub 20 is gradually reduced, the one part of the sealing unit 120 is separated from the space between the fixing unit 110 and the front surface frame 22 of the washing tub 20, and therefore an opening operation of the door 40 may be naturally performed without being hindered by the sealing member 100.

As shown in FIG. 8, when the door 40 starts to close the opening 21 of the washing tub 20 while rotating, the interval G2 between the fixing unit 110 of the sealing member 100 and the front surface frame 22 of the washing tub 20 is gradually increased. The pressurization by the fastening protrusion 116*a* of the fixing unit 110 is released, and the first and second elastic deformation portions 122 and 124 are separated from each other by an elastic restoring force.

As the open angle α of the door 40 is reduced, the fastening protrusion 116*a* of the fixing unit 110 pressurizes the sealing unit 120 in the first direction C1 again, and the elastic restoring force in the first direction C1 is applied, and therefore the sealing unit 120 is gradually restored to its original shape while being bent and deformed in the first direction C1 with respect to the bending guide unit 123.

When the open angle α of the door 40 is 0° by completely closing the opening 21 with the door 40, the sealing unit 120 is completely restored to its original shape to be positioned in the space between the fixing unit 110 and the front surface frame 22 of the washing tub 20 again, and the contact portion 126 of the sealing unit 120 is brought into contact with the inner surface 22*a* of the front surface frame 22 to seal between the door 40 and the washing tub 20.

In this manner, when the door 40 closes the opening 21 of the washing tub 20 while rotating, the sealing state between the door 40 and the washing tub 20 is maintained while the sealing unit 120 is restored to its original shape, and the sealing unit 120 is positioned in the space between the fixing unit 110 and the front surface frame 22 of the washing tub 20 while the space between the fixing unit 110 and the front surface frame 22 of the washing tub 20 is gradually increased, and therefore a closing operation of the door 40 may be naturally performed without being hindered by the sealing member 100.

In the above description, an example in which the sealing member 100 according to the present disclosure is applied to a dishwasher has been described, but obviously, the sealing member 100 may be applied to a clothes dryer, a washing machine, and the like.

As is apparent from the above description, the sealing member may be coupled directly to the door in a simple method, and therefore productivity may be improved.

A part of the sealing member is brought into contact with the front surface frame of the washing tub to seal between the door and the washing tub so that a washing water is introduced between the sealing member and the lower surface frame of the washing tub to remove foreign substances, and therefore a phenomenon in which the foreign substances are accumulated in the space between the sealing member and the washing tub may be prevented.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dishwasher comprising:

a main body;

a washing tub that is disposed inside the main body and includes an opening formed on a front surface thereof and a front surface frame forming the opening;

a door including a first frame to open and close the opening; and a sealing member that seals between the washing tub and the door, wherein the sealing member includes a fixing unit that is fixed to a lower portion of the door, a sealing unit that extends toward the door from the fixing unit and is brought into contact with an inner surface of the washing tub, and at least one strength reinforcement rib protruding from the fixing unit to have a length corresponding to a spaced distance between the first frame and the fixing unit when the door is closed, an end portion of the at least one strength reinforcement rib being brought into contact with the first frame to be supported by the first frame during opening and closing of the door, and wherein the sealing unit forms a closed loop and a hollow is formed inside the closed loop, and when the door is opened, one part of the sealing unit is positioned outside of a space between the fixing unit and the front surface frame of the washing tub, and the other part of the sealing unit is positioned in the space between the fixing unit and the front surface frame.

2. The dishwasher according to claim 1, wherein a hardness of a material of the fixing unit is different from a hardness of a material of the sealing unit.

3. The dishwasher according to claim 2, wherein the fixing unit has relatively greater hardness than that of the sealing unit.

4. The dishwasher according to claim 1, wherein, in a state in which the door closes the opening, a washing water flow path is formed between the sealing member and a lower surface of the washing tub so that a washing water is introduced through the washing water flow path.

5. The dishwasher according to claim 1, wherein the sealing unit includes;

a first elastic deformation portion having one end connected to the fixing unit and a distal end extending from the fixing unit toward the front side of the washing tub, the first elastic deformation portion including a bending guide unit having a shape curved toward the front side of the washing tub; and a second elastic deformation portion having one end connected to the fixing unit at a position vertically below the first elastic deformation portion and a distal end extending from the fixing unit, wherein the first and second elastic deformation portions are elastically deformed in a process in which the door opens and closes the opening.

6. The dishwasher according to claim 5, wherein an interval between the first and second elastic deformation portions is increased in at least a partial section toward the front side of the washing tub.

7. The dishwasher according to claim 1, wherein the fixing unit includes:

a support unit that supports the sealing unit, a first fastening unit that extends toward the front side of the washing tub from an upper end of the support unit, and a second fastening unit that extends toward a lower surface of the washing tub from a lower end of the support unit.

8. The dishwasher according to claim 7, wherein the first fastening unit includes at least one fixing groove.

9. The dishwasher according to claim 8, wherein the second fastening unit includes a fastening protrusion that is bent toward the front side of the washing tub from an end of the second fastening unit.

10. The dishwasher according to claim 9, wherein the door includes the first frame that is formed to cover the opening and a second frame that is disposed on a front side of the first frame, the first frame has a receiving groove that receives the fastening protrusion, and the second frame has at least one insertion protrusion that is inserted into the at least one fixing groove.

11. The dishwasher according to claim 10, wherein at least a part of the second fastening unit is brought into contact with the first frame.

12. The dishwasher according to claim 1, wherein an end portion of the at least one strength reinforcement rib is supported by the first frame.

13. A dishwasher comprising:

a main body;

a washing tub that is disposed inside the main body and includes an opening formed on a front surface thereof and a front surface frame forming the opening;

a door including a first frame to open and close the opening; and a sealing member that seals between the washing tub and the door, wherein the sealing member includes a fixing unit that is fixed to a lower portion of the door, and a sealing unit that extends toward the door from the fixing unit and is brought into contact with an inner surface of the washing tub, at least one strength reinforcement rib protruding from the fixing unit to have a length corresponding to a spaced distance between the first frame and the fixing unit when the door is closed, an end portion of the at least one strength reinforcement rib being brought into contact with the first frame to be supported by the first frame during opening and closing of the door, wherein the sealing unit forms a closed loop and a hollow is formed inside the closed loop, and as the door is opened, the hollow narrows and then the closed loop is deformed by the front surface frame and the first frame so that inner walls of the closed loop overlap each other.

14. The dishwasher according to claim 13, wherein a hardness of a material of the fixing unit is different from a hardness of a material of the sealing unit.

15. The dishwasher according to claim 14, wherein the fixing unit has relatively greater hardness than that of the sealing unit.

16. The dishwasher according to claim 13, wherein, in a state in which the door closes the opening, a washing water flow path is formed between the sealing member and a lower surface of the washing tub so that a washing water is introduced through the washing water flow path.

17. The dishwasher according to claim 13, wherein the sealing unit includes:

a first elastic deformation portion having one end connected to the fixing unit and a distal end extending from the fixing unit toward the front side of the washing tub, the first elastic deformation portion including a bending guide unit having a shape curved toward the front side of the washing tub; and a second elastic deformation portion having one end connected to the fixing unit at a position vertically below the first elastic deformation portion and a distal end extending from the fixing unit, wherein the first and second elastic deformation portions are elastically deformed in a process in which the door opens and closes the opening.

18. The dishwasher according to claim 17, wherein an interval between the first and second elastic deformation portions is increased in at least a partial section toward the front side of the washing tub.

19. The dishwasher according to claim 13, wherein the fixing unit includes:

a support unit that supports the sealing unit;

a first fastening unit that extends toward the front side of the washing tub from an upper end of the support unit; and a second fastening unit that extends toward a lower surface of the washing tub from a lower end of the support unit.

20. The dishwasher according to claim 19, wherein the first fastening unit includes at least one fixing groove.

21. The dishwasher according to claim 20, wherein the second fastening unit includes a fastening protrusion that is bent toward the front side of the washing tub from an end of the second fastening unit.

22. The dishwasher according to claim 21, wherein the door includes the first frame that is formed to cover the opening and a second frame that is disposed on a front side of the first frame, the first frame has a receiving groove that receives the fastening protrusion, and the second frame has at least one insertion protrusion that is inserted into the at least one fixing groove.

23. The dishwasher according to claim 22, wherein at least a part of the second fastening unit is brought into contact with the first frame.

* * * * *